US011785373B1

(12) United States Patent
Amzaleg

(10) Patent No.: US 11,785,373 B1
(45) Date of Patent: Oct. 10, 2023

(54) EAR HOOKS

(71) Applicant: Amzaleg's, LLC, Woodland Hills, CA (US)

(72) Inventor: Or Amzaleg, Woodland Hills, CA (US)

(73) Assignee: Amzaleg's, LLC, Woodland Hills, CA (US)

( * ) Notice: Subject to any disclaimer, the term of this patent is extended or adjusted under 35 U.S.C. 154(b) by 35 days.

(21) Appl. No.: 17/825,855

(22) Filed: May 26, 2022

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01); *H04R 1/1066* (2013.01)

(58) Field of Classification Search
CPC .... H04R 1/105; H04R 1/1016; H04R 1/1058; H04R 5/0335
See application file for complete search history.

(56) References Cited

U.S. PATENT DOCUMENTS

2009/0285434 A1* 11/2009 Williams ..... H04R 1/1091 381/381

* cited by examiner

*Primary Examiner* — Amir H Etesam
(74) *Attorney, Agent, or Firm* — Welsh IP Law LLC

(57) ABSTRACT

A system for positioning an earbud relative to the ear of a person includes an ear frame that extends between a first end and a second end. The ear frame extends in an ear frame plane defined by the first end, the second end, and a top portion. The system further includes an earbud receiver configured to receive a stem of an earbud. The earbud receiver is connected to the ear frame. The earbud receiver defines a bore extending along an earbud receiver axis between a first opening at a first end of the earbud receiver and a second opening at a second end of the receiver. The earbud receiver axis intersects the ear frame plane an angle theta selected to retain the position the earbud relative to the ear of the person. In some embodiments, theta is selected between 5 degrees and 30 degrees.

20 Claims, 10 Drawing Sheets

EAR HOOKS

TECHNICAL FIELD

The invention generally relates to an earbud retention and stabilization system. More particularly, the invention relates to an earbud retention and stabilization system that enables earbud headphones to be effectively retained relative to the ears of a user.

BACKGROUND

Earbuds have become very common and popular over the past few years. Earbuds are speaker headsets where the speaker is small enough to fit inside the ear. Earbuds are supplied with many portable music players and with most cell phones.

Wireless earbuds are available. These wireless earbuds have the same fit, comfort, and stability issues as the wired earbuds. Newer wireless earbuds also present the bigger issue of simple loss if an earbud falls out. With the high cost of these new wireless earbuds, loss is a significant issue. Such earbuds include Apple AirPods Pro®, Apple AirPods ($1^{st}$ Generation)®, Apple AirPods (2nd Generation)®, and Apple AirPods (3rd Generation)®. The earbud may include, for example, a speaker section that is configured to be at least partially received in the outer ear of the user. The earbud further includes a stem extending from the speaker section to a distal point. The stem may define a circular outer cross section in a plane perpendicular to the axis of the stem. The stem may include a microphone proximate to its distal end and the stem may include an interface on a surface thereof that can be tactically actuated.

Earbuds are especially troublesome if the user is active or moving. Jogging, biking, skiing, working out, or simply walking are all example activities that can cause earbuds to fall out. Sometimes just turning one's head can cause earbuds to come out. To prevent this, some users will push the earbuds further in their ear, leading to discomfort.

Thus, there exists a need in the art for an improved system and method for retaining the ear bud relative to the ear of a user.

SUMMARY OF THE INVENTION

The needs set forth herein as well as further and other needs and advantages are addressed by the present teachings, which illustrate solutions and advantages described below.

The present invention resides in one aspect in a system for positioning an earbud relative to the ear of a person. The system comprises an ear frame configured to fit over an ear of a user. The ear frame extends between a first end and a second end. The ear frame has a top portion disposed between the first end and the second end. The ear frame defines a first side that is adjacent to a head of the person and a second side that is oppositely disposed relative to the first side. The ear frame extends in an ear frame plane defined by the first end, the second end, and the top portion. The system further includes an earbud receiver configured to receive a stem of an earbud. The earbud receiver is connected to the ear frame. The earbud receiver defines a bore extending along an earbud receiver axis between a first opening at a first end of the earbud receiver and a second opening at a second end of the receiver. The bore defines a concave arcuate surface on an inner surface thereof. The earbud receiver axis intersects the ear frame plane an angle theta selected to retain the position the earbud relative to the ear of the person.

In yet a further embodiment of the present invention, theta is between 10 degrees and 20 degrees.

In yet a further embodiment of the present invention, theta is between 13 degrees and 17 degrees.

In yet a further embodiment of the present invention, theta is 15 degrees.

In yet a further embodiment of the present invention, the system for positioning an earbud relative to an ear further comprises a recess defined by the earbud receiver. The recess extends in a direction radially outward from the earbud receiver axis and between the bore and an outside surface of the earbud receiver.

In yet a further embodiment of the present invention, the recess in the earbud receiver is positioned relative to a stem of an earbud received in the earbud receiver so that an interface on the stem is tactically accessible through the recess.

In yet a further embodiment of the present invention, the earbud receiver and the ear frame are integral.

In yet a further embodiment of the present invention, the second end of the earbud receiver defines a bezel between the second opening and an outer surface of the earbud receiver.

In yet a further embodiment of the present invention, the ear frame comprises molded silicone and the earbud receiver comprises molded silicone rubber.

In yet a further embodiment of the present invention, the molded silicone rubber has a durometer of between 70 and 90 on the Shore A hardness scale.

In yet a further embodiment of the present invention, the molded silicone rubber has a durometer of 80 on the Shore A hardness scale.

The present invention resides in yet another aspect in an ear hook for an earbud having a stem extending therefrom. The ear hook comprises an ear frame extending between a first end and a second end and defining a c-shape between the first end and the second end. The ear frame extends in an ear frame plane. The system further comprises an earbud receiver configured to receive a stem of an earbud. The earbud receiver is connected to the ear frame proximate to the first end of the frame. The earbud receiver has a receiving channel extending along an earbud receiver axis between a first opening at a first end of the earbud receiver and a second opening at a second end of the ear bud receiver. The receiving channel is configured to receive the stem of the earbud and retain a position of the earbud relative to the ear hook via a friction fit between the stem and an inside surface of the receiving channel. The earbud receiver axis intersects the ear frame plane at an angle theta. Theta is between 5 degrees and 30 degrees.

It yet a further embodiment of the present invention of the ear hook for an earbud having a stem extending therefrom, theta is between 10 degrees and 20 degrees.

It yet a further embodiment of the present invention of the ear hook for an earbud having a stem extending therefrom, theta is between 13 degrees and 17 degrees.

In yet a further embodiment of the present invention, the ear hook further comprises an opening in the earbud receiver extending from the receiver channel radially outwards from the earbud receiver axis through the earbud receiver to an interface opening on an outside surface of the earbud receiver.

In yet a further embodiment of the present invention, the receiving channel is at least 7 mm as measured from the first opening to the second opening along the earbud receiver axis.

In yet a further embodiment of the present invention, the interface opening in the earbud receiver is positioned relative to a stem of an earbud received in the earbud receiver so that an interface on the stem is tactically accessible through the interface opening.

In yet a further embodiment of the present invention, the earbud receiver is integral with ear frame.

In yet a further embodiment of the present invention, ear frame comprises silicone and the earbud receiver comprises silicone.

In yet a further embodiment of the present invention, the ear frame has a durometer of between 70 and 90 on the Shore A hardness scale.

These and other aspects of the present invention will become apparent in light of the drawings and detailed description provided below.

DETAILED DESCRIPTION

Figure 1:
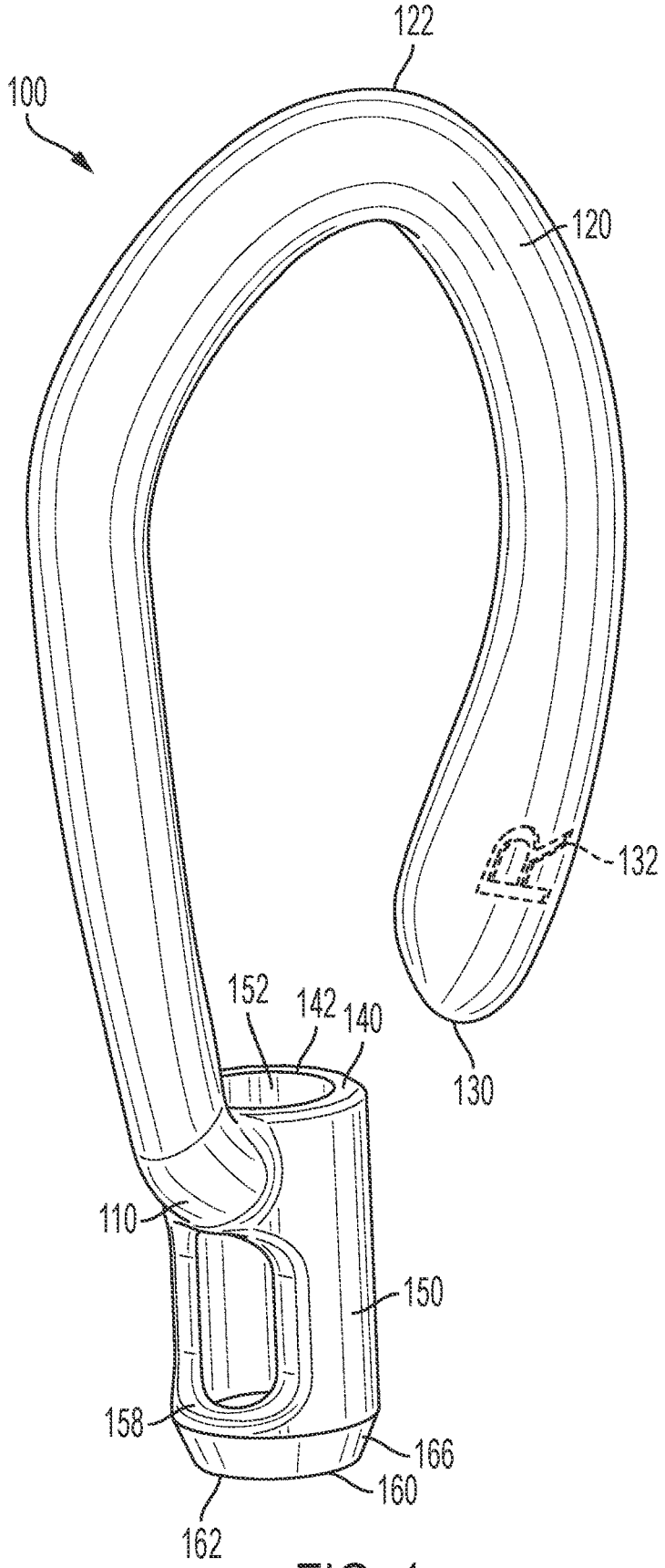
FIG. 1 illustrates a front, top, and left perspective view of an ear hook for an earbud in accordance with one embodiment of the present invention.

The present disclosure describes aspects of the present invention with reference to the exemplary embodiments illustrated in the drawings; however, aspects of the present invention are not limited to the exemplary embodiments illustrated in the drawings. It will be apparent to those of ordinary skill in the art that aspects of the present invention include many more embodiments. Accordingly, aspects of the present invention are not to be restricted in light of the exemplary embodiments illustrated in the drawings. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

In reference to FIGS. 1-14, a system 100, 100' for positioning an earbud relative to the ear of a person is shown. The system 100, 100' may also be referred to as an ear hook herein. The ear hook 100, 100' in accordance with the present invention is configured to be used on the left side or the right side of the body. In some embodiments of the present invention, the ear hook 100 is configured to retain an ear bud on right side of the body, namely in position relative to the right ear of the wearer. In another embodiment of the present invention, the ear hook 100' is configured to retain an ear bud on the left side of the body, namely in position relative to the left ear of the wearer. In some embodiments of the present invention, the ear hooks 100, 100' are provided as a pair that includes an ear hook for the right side of the body 100 and an ear hook for the left side of the body 100'. FIGS. 1-7 illustrate an ear hook for use on the right side of the body. FIGS. 8 -14 illustrate an ear hook for use on the left side of the body. The same reference numbers are used in association with both embodiments, with the exception that the right sided embodiment illustrated in FIGS. 8-14 are denoted with the reference number followed by the designation prime. For example, reference number 100 references the right-sided ear hook shown in FIGS. 1-7 and reference number 100' references the left-sided ear hook shown in FIGS. 8-14. The embodiments disclosed in FIGS. 1-14 are discussed jointly except where necessary to address side specific details.

The system for positioning and or fixing an earbud relative to the ear of a person 100, 100' includes an ear frame 120, 120' and an earbud receiver 150, 150'. The ear frame 120, 120' extends between a first end 110, 110' and a second end 130, 130'. The ear frame 100, 100' is similar in form to the tip of the temple portion of eye glass frames. The ear frame 100, 100' is shaped so that the first end is proximate to the ear canal and more specifically proximate to the intertragic notch of the ear. The ear frame 120, 120' extends of the top of the ear between the helix and the side of the head and extend to the second end of the ear frame 130, 130'. The c-shape of the ear frame 120, 120' is configured to hook across the top of the ear in the above described manner and retain the system 100, 100' in position relative to the ear of the user. The ear hooks 100, 100' in accordance with the present invention are available in different size version wherein the C-shape is made smaller or bigger, as the case may be, to appropriately fit the size of the ear and head of a person wearing the device.

The ear frame 100, 100' defines a convex arcuate surface in a plane perpendicular to the length of the ear frame 100, 100' between the first end 110, 110' and the second end 130, 130'. In reference to the embodiments shown in FIGS. 1-14, the cross section becomes flatter toward and area 134, 134' proximate to the second end 130, 130' of the ear frame 120, 120' to provide an additional support surface extending substantially parallel to an adjacent portion of the wearer's head proximate thereto.

The ear frame 120, 120' has a first side 126, 126' that is adjacent to a head of the person when the ear frame 100, 100' is received over the ear of the user. The ear frame 120, 120' defines a second side 128, 128' that is oppositely disposed relative to the first side 126, 126'. The ear frame 120, 120' includes a top portion 122, 122'. The ear frame 120, 120' defines an ear frame plane 124, 124' that extends between the first end 110, 110', the second 130, 130', and the upper portion 122, 122'. In the embodiment discussed herein, the plane bisects the upper portion 122, 122', the first end 110, 110', and the second end 130, 130' at a respective point between the first side 126, 126' and the second side. In this manner, the c-shaped ear frame 120, 120' is substantially planar extending in the ear frame plane 124, 124' . It will be understood by a person or ordinary shill in the art and familiar with this disclosure that substantially planar means arranged along a single plane with portions of the elements extending off the plane to account for the design of ear frame and to accommodate the anatomy of the wearer.

The system 100, 100' further includes an earbud receiver 150, 150' connected to the first end 110, 110' of the ear frame 120, 120'. The ear bud receiver 150, 150' is configured to receive the stem of an earbud. The ear bud receiver 150, 150' extends between a first end 140, 140' and a second end 160, 160'. The ear bud receiver 150, 150' defines a bore 152, 152' that extends along an earbud receiver axis 154, 154' from a first opening 142, 142' at the first end 150, 150' of the earbud receiver to a second opening 162, 162' at the second end 160, 160' of the earbud receiver 150, 150'. In the embodiment disclosed in the FIGS., the earbud receiver axis is linear. The bore 152, 152' defines a concave arcuate inner surface in a cross-sectional plane perpendicular to the earbud receiver axis 154, 154'. The bore 152, 152' is configured to receive the stem of the earbud and to fix the position of the earbud relative to the earbud receiver 150, 150' via a friction fit or interference fit between the inside surface of the bore 152, 152' and the outside surface of the stem of the earbud. The interference fit is such that it retains the position of the earbud relative the earbud receiver when the user is wearing the ear hook during activity, while simultaneously allowing the user to remove the ear bud from the earbud receiver by applying a tension force between the earbud and the earbud receiver along the earbud receiver axis 154, 154'. In this manner, the user can disengage the earbud from the ear hook. The user can receive the earbud into the earbud receiver by applying an opposition force.

The length of the bore 152, 152' may vary according to different embodiments. It some embodiments of the present invention the length of the bore 152, 152' between the first opening 142, 142' and the second opening 162, 162' is selected so as to retain the earbud and to inhibit torsion of the earbud relative to the hook and the earbud receiver 150, 150' during use thereof. In some embodiments, the length of the bore is at least 4 mm. In other embodiments, the length of the bore is at least 7 mm. In yet other embodiments of the present invention, the length of the bore is at least 10 mm. In yet other embodiments of the present invention, the length of the bore is greater than 10 mm. A person of ordinary skill in the art and familiar with the invention will understand the length of the bore may vary to accommodate different earbuds having different length stems.

In reference to the embodiment disclosed, in the FIGS., the earbud receiver 150, 150' defines a recess 158, 158' that extends radially outward in a direction perpendicular to the earbud receiver axis 154, 154'. The recess 158, 158' defines in aperture in the size of the earbud receiver. The recess 158, 158' is positioned in the earbud receiver relative to a stem of an earbud received in the earbud receiver so that an interface on the stem is tactically accessible through the recess. For example, if the stem of an AirPod® Pro is received in the earbud receiver 150, 150', a force sensor on the outside surface of the AirPod stem is tactically accessible through the recess. In further reference to the embodiment shown in the FIGS., the length of the bore is selected so that a distal end of the earbud stem extends past the second opening 162, 162' of the bore 152, 152', thereby providing direct access to a microphone in the distal end of the stem. It will be understood to a person of ordinary skill in the art and familiar with the invention that the position of the of the recess and size and shape of the bore may vary to accommodate different function and interfaces of a corresponding earbud intended for use with the ear hook.

In the embodiment disclosed in the FIGS., the second end 160, 160' of the earbud receiver 150, 150' defines a bezel 166 between the second opening 162, 162' and an outer surface of the earbud receiver 150, 150'. A person of ordinary skill in the art and familiar with the invention will understand that although a bezel is shown with the disclosed embodiments, the present invention is not limited in this regard.

In the embodiment disclosed in the FIGS., the ear frame 120, 120' and the earbud receiver 150, 150' are integral at the first end 110, 110' of the ear frame 120, 120'. It should be understood that the present invention is not limited in this regard. For example, the ear frame 120, 120' and the ear bud receiver may comprise separate pieces that are connected relative to each other via a fastener or method of fixation such as an adhesive or the like as may be known in the art.

Figure 2:
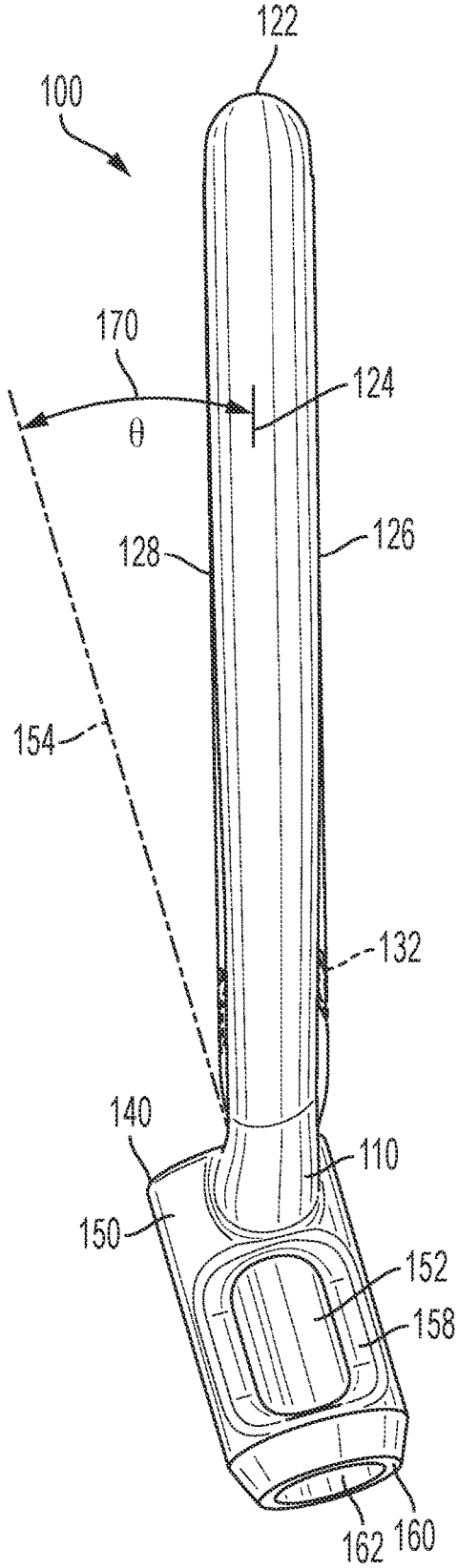
FIG. 2 is a left side elevational view of the ear hook shown in FIG. 1.
Figure 3:
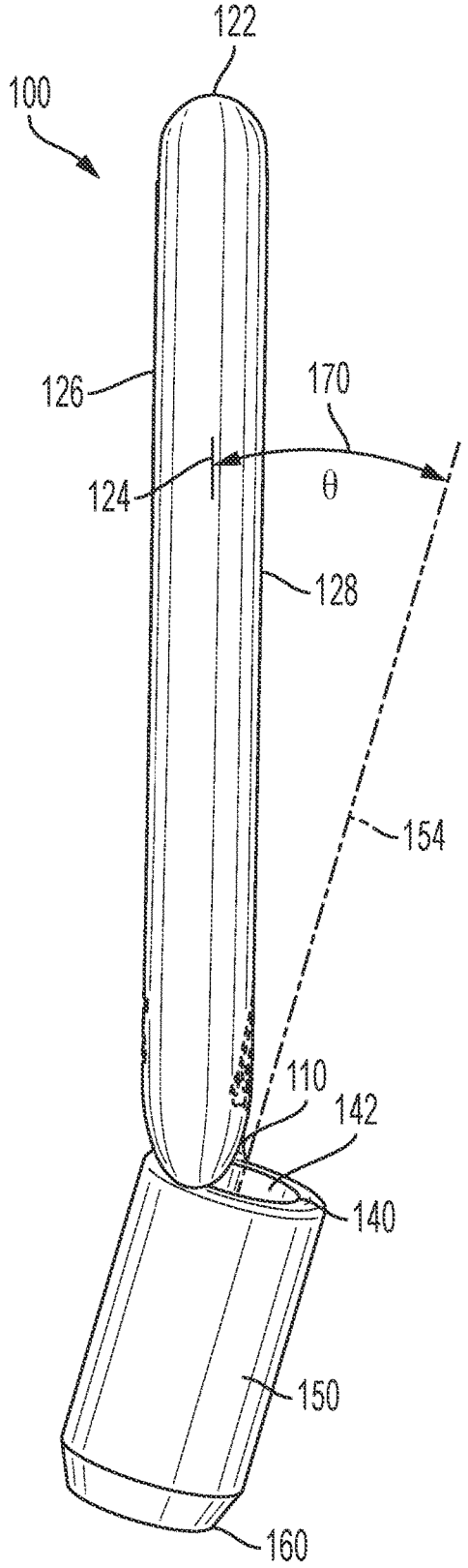
FIG. 3 is a right side elevational of the ear hook shown in FIG. 1.
Figure 4:
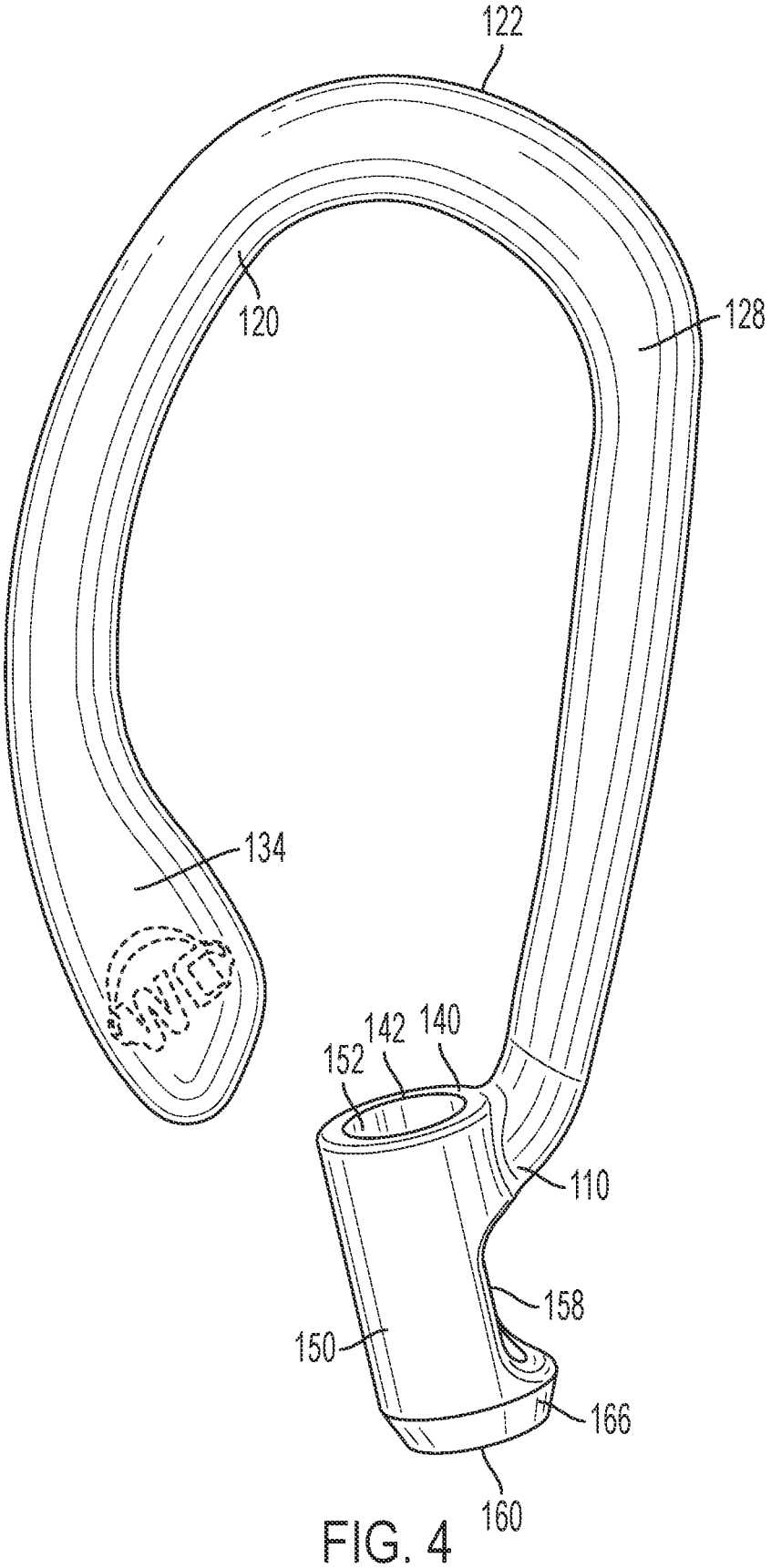
FIG. 4 is a rear elevational view of the ear hook shown in FIG. 1.
Figure 5:
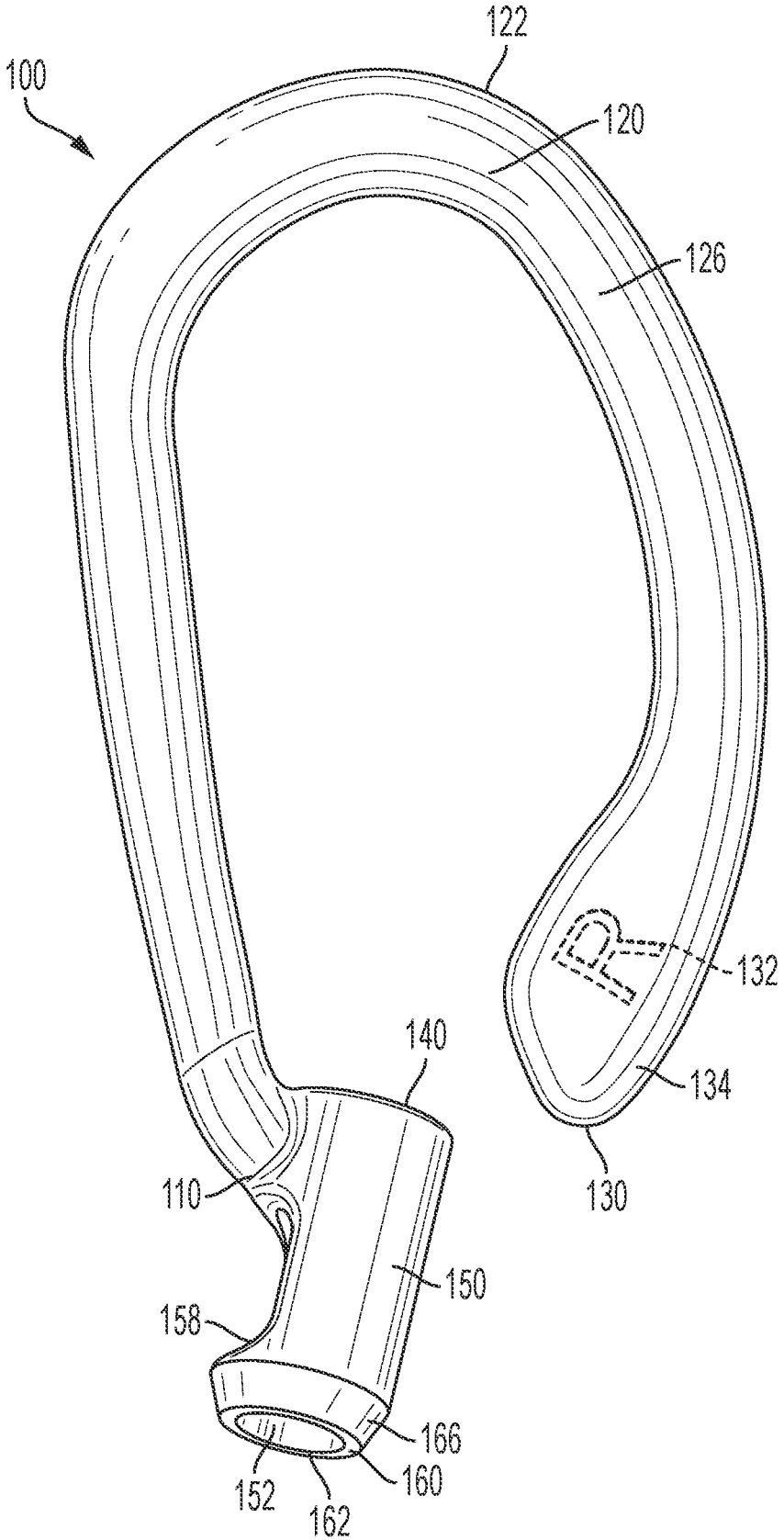
FIG. 5 is a front elevational view of the ear hook shown in FIG. 1.
Figure 6:
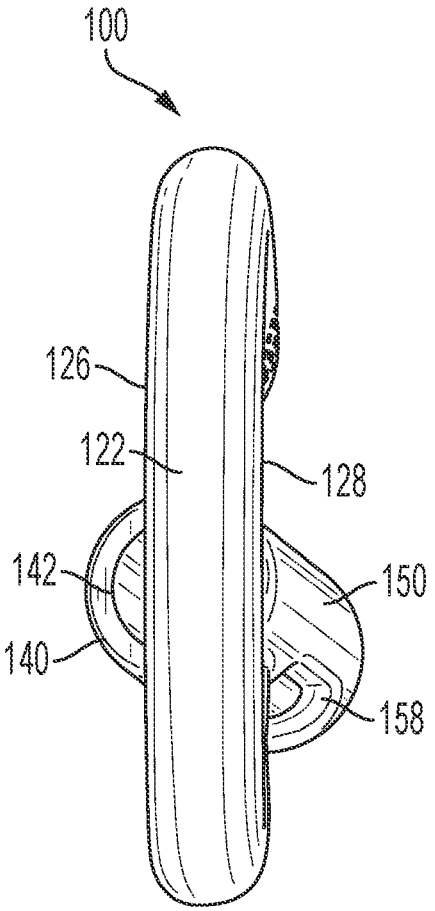
FIG. 6 is a top plan view thereof of the ear hook shown in FIG. 1.
Figure 7:
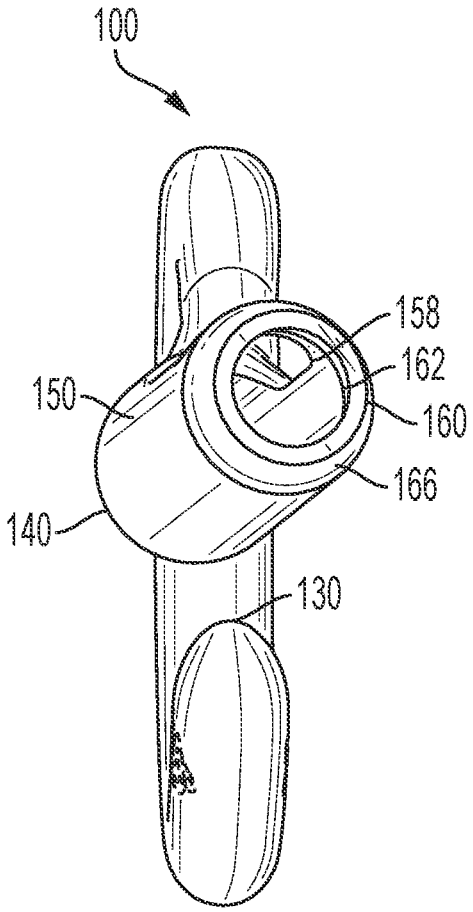
FIG. 7 is a bottom plan thereof of the ear hook shown in FIG. 1.
Figure 8:
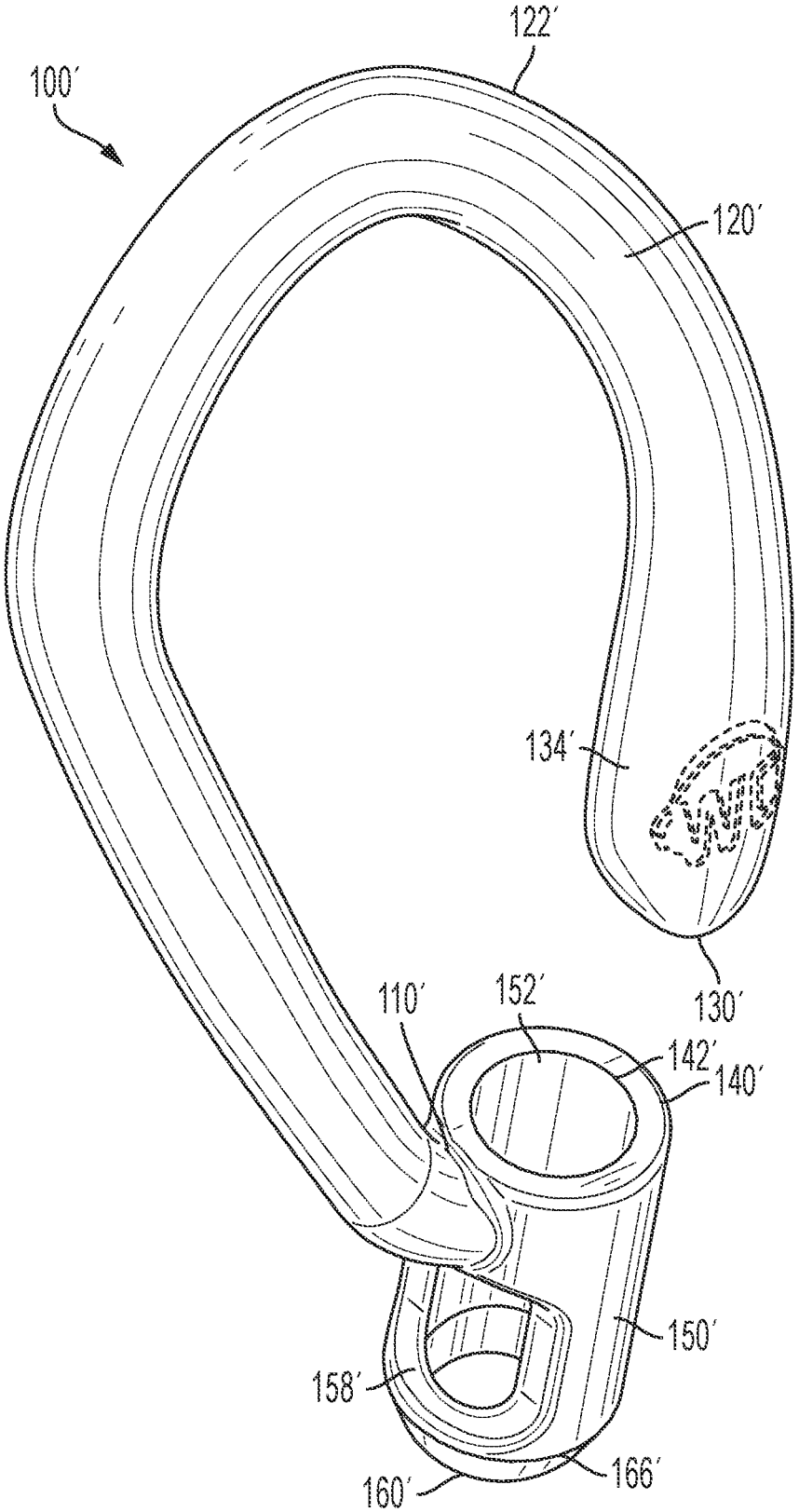
FIG. 8 illustrates a front, top, and left perspective view of an ear hook for an earbud in accordance with one embodiment of the present invention.

In reference to FIGS. 2 and 3, the earbud receiver 150, 150' is connected to the first end 110, 110' of the ear frame 120, 120' so that earbud receiver axis 154, 154' insects the ear frame plane 124, 124' at angle theta. The angle theta is measured from the ear frame plane 124, 124' in the direction of the second side 128 of the ear frame 120, 120' to the earbud receiver axis 154, 154'. In this manner, theta is an acute angle. The angle theta 170, 170' is selected so that first opening 142, 142' of the bore is tilted away from the head of the user, while the second opening 162, 162' of the bore 154, 154' is tilted toward the head of the user. In this manner, the ear hook 100, 100' in accordance with the present invention is configured to retain the ear in position in the outer ear canal while the user engages in physical activity and exercise. The inventor has discovered that by selecting the angle theta 170, 170', the ear hooks in accordance with the present invention do not push the earbuds out of the outer ear canal of the person wearing them as is known to occur in the art.

In the embodiment disclosed in the FIGS., theta 170, 170' is selected between 5 degrees and 30 degrees. In another embodiment, theta 170, 170' is between 10 degrees and 20 degrees. In yet a further embodiment of the present invention theta is selected between 13 and 17 degrees. In the embodiment disclosed in the FIGS, theta is 15 degrees. It should be understood to a person having ordinary skill in the art and being familiar with the invention, that theta may vary while still providing a system that retains the earbud in position relative to the ear. The inventors have discovered that selecting an angle theta between 10 and 20 degrees, and more preferably between 13 and 17 degrees and most preferably at around 15 degrees provides the desired qualities for use with the earbuds and the AirPod products referenced in the description.

Figure 9:
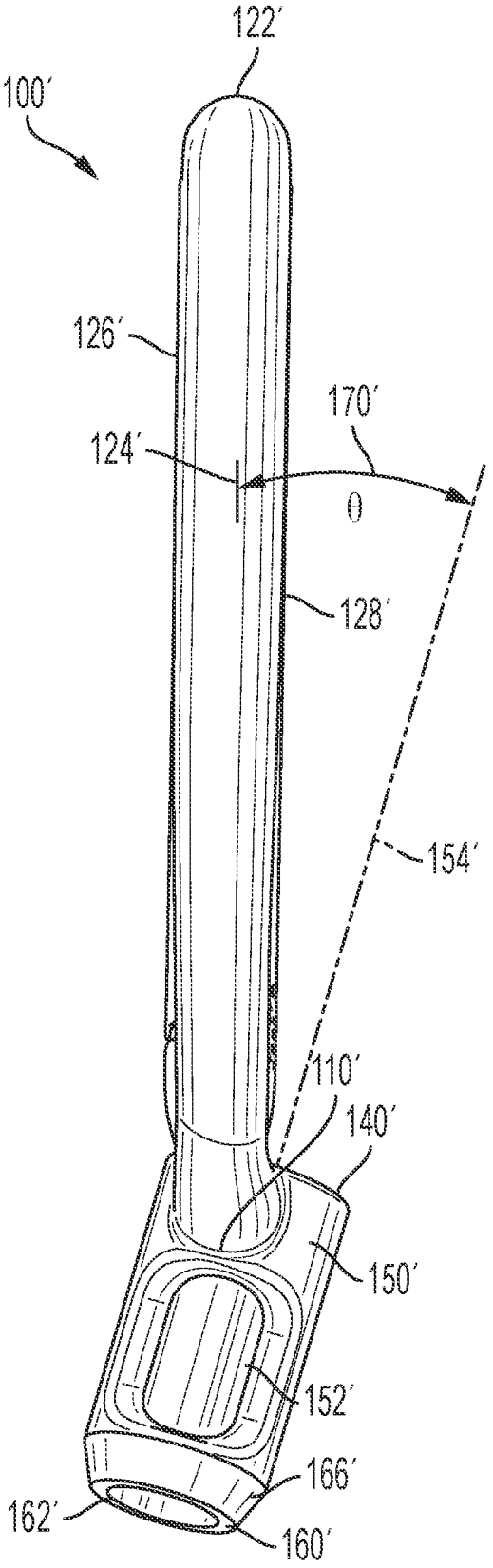
FIG. 9 is a left side elevational view of the ear hook shown in FIG. 8.
Figure 10:
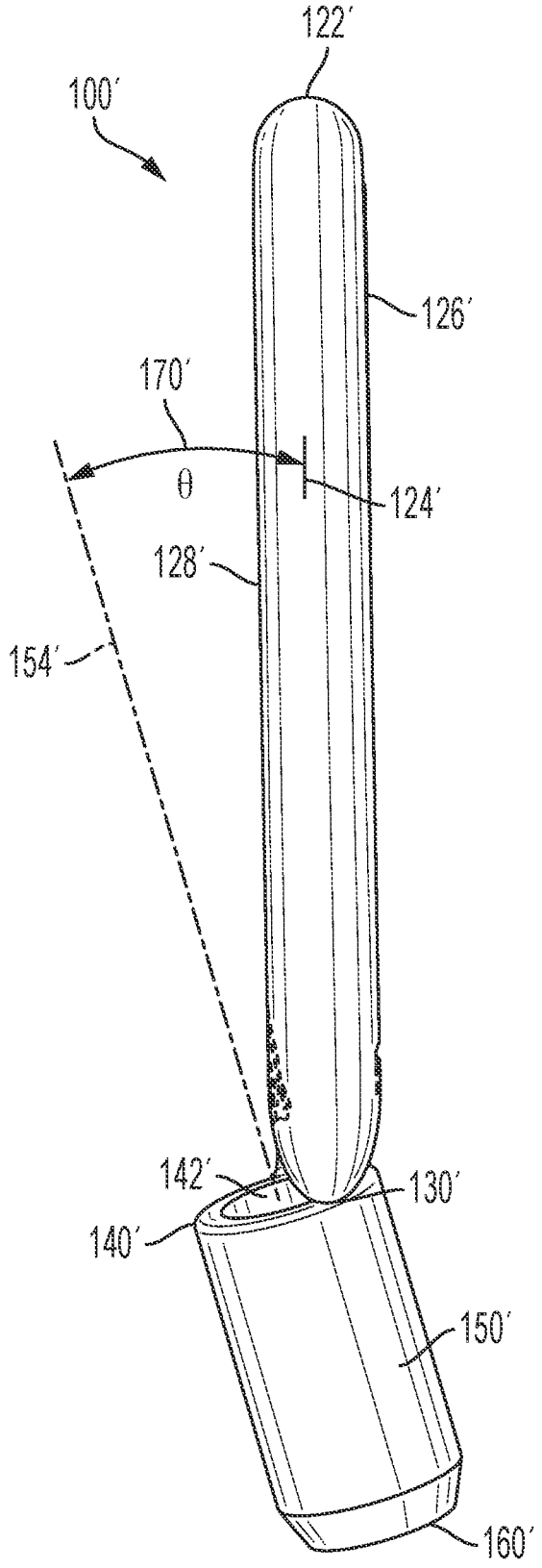
FIG. 10 is a right side elevational of the ear hook shown in FIG. 8.
Figure 11:
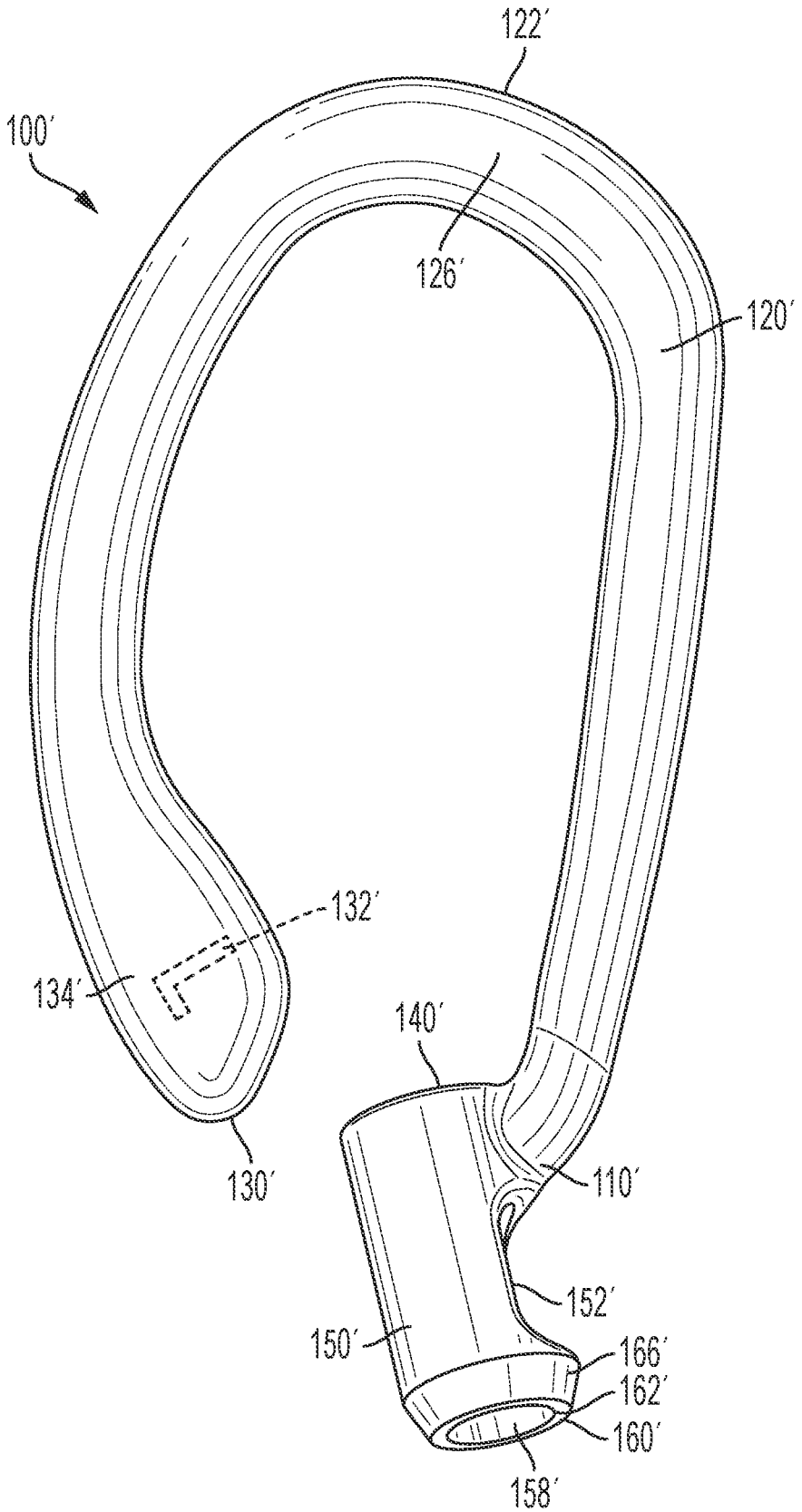
FIG. 11 is a rear elevational view of the ear hook shown in FIG. 8.
Figure 12:
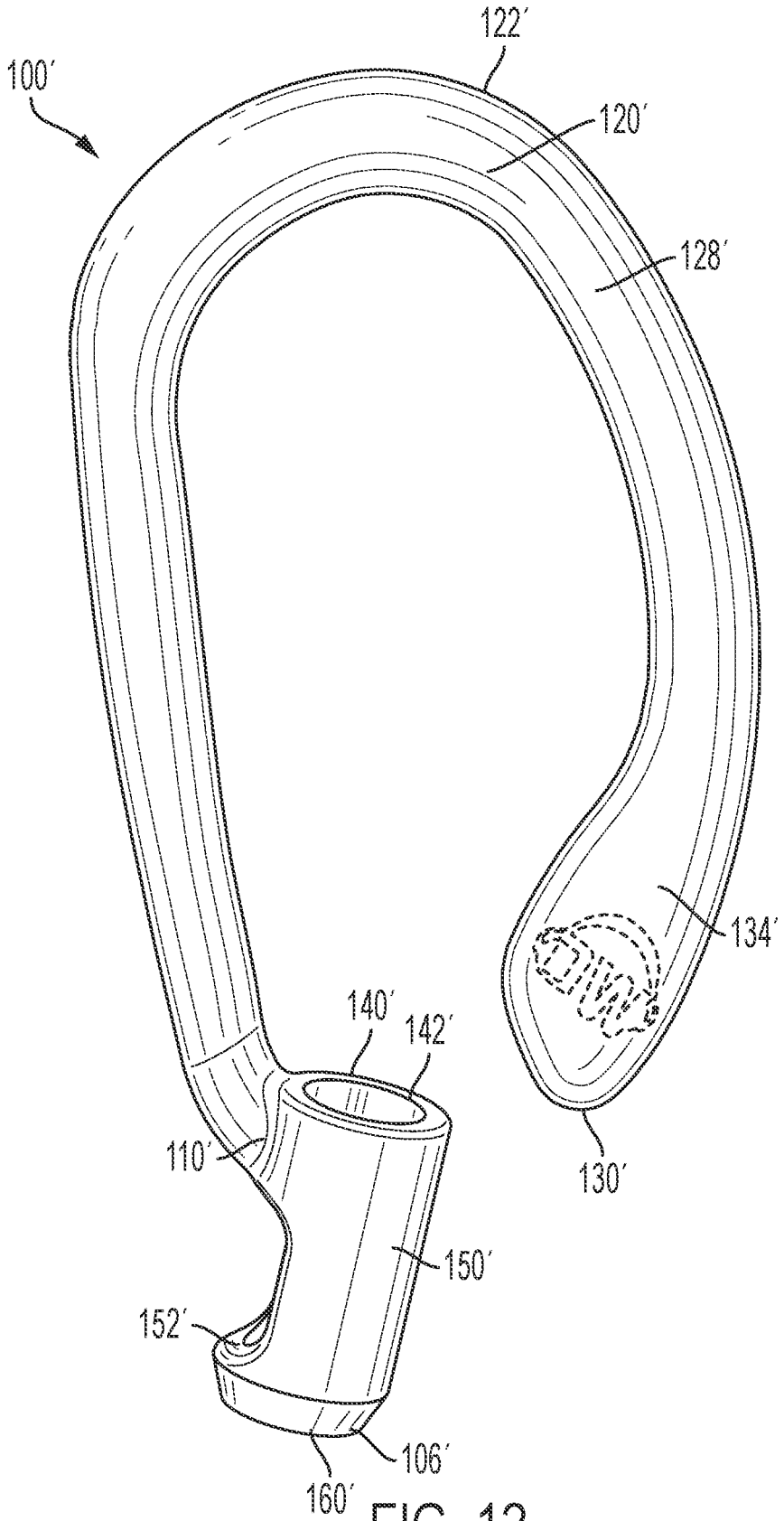
FIG. 12 is a front elevational view of the ear hook shown in FIG. 8.
Figure 13:
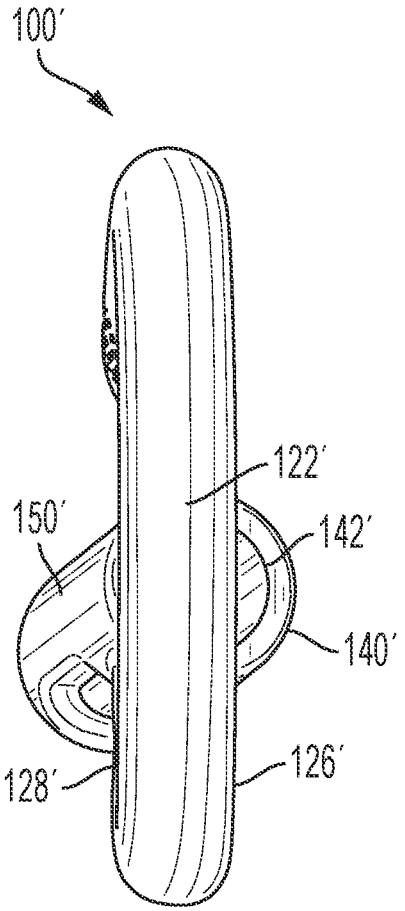
FIG. 13 is a top plan view thereof of the ear hook shown in FIG. 8.
Figure 14:
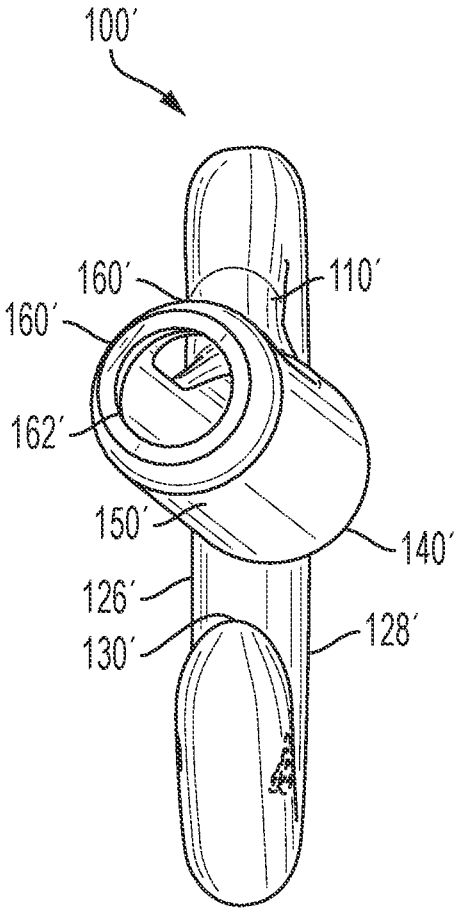
FIG. 14 is a bottom plan thereof of the ear hook shown in FIG. 8.

In reference to FIGS. 9 and 10, a left side version of the ear hook 100, 100" is shown. The ear hook is a mirror image of the ear hook 100, 100' disclosed in FIGS. 1-7.

The ear hooks in accordance with the present invention may be manufactured from materials and techniques that are known in the art including different types of extruded and molded polymers. In one embodiment of the present invention, the ear hooks are manufactured from silicone molded rubber. In this technique, a heated silicone rubber is injected into the mold to form the desired shape of the ear hooks.

In the embodiments disclosed, the hardness of the ear hooks may vary. In one embodiment of the present invention, the ear hooks have a durometer of between 70 and 90 on the Shore A hardness scale. In yet another embodiment of the present invention, the ear hooks have a durometer of 80 on the Shore A hardness scale. In yet a further embodiment of the present invention, the ear hooks comprises silicone molded rubber with the above reference durometers. The inventor has discovered that selecting a hardness within this range provides the appropriates combination of flexibility and stiffness to support the earbud and position the earbud relative to the ear of the user.

The present invention also resides in the ornamental design disclosed in the FIGS.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

What is claimed is:

1. A system for positioning an earbud relative to the ear of a person, the system comprising:

an ear frame configured to fit over an ear of a user, the ear frame extending between a first end and a second end, the ear frame having a top portion disposed between the first end and the second end, the ear frame defining a first side that is adjacent to a head of the person and a second side that is oppositely disposed relative to the first side, the ear frame extending in an ear frame plane defined by the first end, the second end, and the top portion;

an earbud receiver configured to receive a stem of an earbud, the earbud receiver connected to the ear frame, the earbud receiver defining a bore extending along an earbud receiver axis between a first opening at a first end of the earbud receiver and a second opening at a second end of the receiver, the bore defining a concave arcuate surface on an inner surface thereof;

wherein the earbud receiver axis intersects the ear frame plane an angle theta selected to retain the position the earbud relative to the ear of the person;

wherein theta is between 5 degrees and 30 degrees.

2. The system for positioning an earbud relative to an ear of a person according to claim 1, wherein theta is between 10 degrees and 20 degrees.

3. The system for positioning an earbud relative to an ear of a person according to claim 2, wherein theta is between 13 degrees and 17 degrees.

4. The system for positioning an earbud relative to an ear of a person according to claim 3, wherein theta is 15 degrees.

5. The system for positioning an earbud relative to an ear of a person according to claim 1, further comprising:

a recess defined by the earbud receiver, the recess extending in a direction radially outward from the earbud receiver axis and between the bore and an outside surface of the earbud receiver.

6. The system for positioning an earbud relative to an ear of a person according to claim 5, wherein the recess in the earbud receiver is positioned relative to a stem of an earbud received in the earbud receiver so that an interface on the stem is tactically accessible through the recess.

7. The system for positioning an earbud relative to an ear of a person according to claim 5, wherein the earbud receiver and the ear frame are integral.

8. The system for positioning an earbud relative to an ear of a person according to claim 7, wherein the second end of the earbud receiver defines a bezel between the second opening and an outer surface of the earbud receiver.

9. The system for positioning an earbud relative to an ear of a person according to claim 7, wherein the ear frame comprises silicone and the earbud receiver comprises molded silicone rubber.

10. The system for positioning an earbud relative to an ear of a person according to claim 9, wherein the molded silicone rubber has a durometer of between 70 and 90 on the Shore A hardness scale.

11. The system for positioning an earbud relative to an ear of a person according to claim 10, wherein the molded silicone rubber has a durometer of 80 on the Shore A hardness scale.

12. An ear hook for an earbud having a stem extending therefrom, the ear hook comprising:

an ear frame extending between a first end and a second end and defining a c-shape between the first end and the second end, the ear frame extending in an ear frame plane;

an earbud receiver configured to receive a stem of an earbud, the earbud receiver connected to the ear frame proximate to the first end of the frame, the earbud receiver having a receiving channel extending along an earbud receiver axis between a first opening at a first end of the earbud receiver and a second opening at a second end of the ear bud receiver, the receiving channel configured to receive the stem of the earbud and retain a position of the earbud relative to the ear hook via a friction fit between the stem and an inside surface of the receiving channel;

wherein the earbud receiver axis intersects the ear frame plane at an angle theta;

wherein theta is between 5 degrees and 30 degrees.

13. The ear hook for an earbud having a stem extending therefrom according to claim 12, wherein theta is between 10 degrees and 20 degrees.

14. The ear hook for an earbud having a stem extending therefrom according to claim 13, wherein theta is between 13 degrees and 17 degrees.

15. The ear hook for an earbud having a stem extending therefrom according to claim 14, further comprising:

an opening in the earbud receiver extending from the receiver channel radially outwards from the earbud receiver axis through the earbud receiver to an interface opening on an outside surface of the earbud receiver.

16. The ear hook for an earbud having a stem extending therefrom according to claim 15, wherein the receiving channel is at least 7 mm as measured from the first opening to the second opening along the earbud receiver axis.

17. The ear hook for an earbud having a stem extending therefrom according to claim 16, wherein the interface opening in the earbud receiver is positioned relative to a stem of an earbud received in the earbud receiver so that an interface on the stem is tactically accessible through the interface opening.

18. The ear hook for an earbud having a stem extending therefrom according to claim 17, wherein the earbud receiver is integral with ear frame.

19. The ear hook for an earbud having a stem extending therefrom according to claim 18, wherein the ear frame comprises silicone and the earbud receiver comprises silicone.

20. The ear hook for an earbud having a stem extending therefrom according to claim 19, wherein the silicone has a durometer of between 70 and 90 on the Shore A hardness scale.

* * * * *